United States Patent [19]

Andrikian et al.

[11] Patent Number: 4,777,456

[45] Date of Patent: Oct. 11, 1988

[54] MICROWAVE ATTENUATOR

[75] Inventors: Charles P. Andrikian, Los Angeles; James K. Shimizu, Palos Verdes Estates, both of Calif.

[73] Assignee: Hughes Aircraft Company, Los Angeles, Calif.

[21] Appl. No.: 83,490

[22] Filed: Aug. 10, 1987

[51] Int. Cl.[4] ..... H01P 1/22

[52] U.S. Cl. ..... 333/81 A; 333/246

[58] Field of Search ..... 333/81 R, 81 A, 161

[56] References Cited

U.S. PATENT DOCUMENTS

| | | | |
|---|---|---|---|
| 2,670,461 | 2/1954 | Learned | 333/81 A |
| 2,961,621 | 11/1960 | Tanenbaum et al. | 333/81 A |
| 3,070,764 | 12/1962 | Douglas | 333/81 A |
| 3,218,583 | 11/1965 | Pon et al. | 333/81 A |

FOREIGN PATENT DOCUMENTS

| | | | |
|---|---|---|---|
| 84/01473 | 4/1984 | PCT Int'l Appl. | 333/81 A |

*Primary Examiner*—Paul Gensler

*Attorney, Agent, or Firm*—Mark J. Meltzer; A. W. Karambelas

[57] ABSTRACT

A high performance, low cost variable attenuator is disclosed with minimal size and weight requirements. The variable microwave attenuator of the present invention includes a microwave stripline transmission line connecting the input and the output thereof; first and second ground planes are disposed on opposite sides of the transmission line; and a dielectric card having a metallization pattern is disposed on at least a portion thereof. The card is adapted for variable interposition between the transmission line and the first ground plane to provide variable attenuation of microwave energy. A specific teaching of the invention relates to the design of the metallization pattern to provide vernier attenuation.

9 Claims, 2 Drawing Sheets

FIG. 2
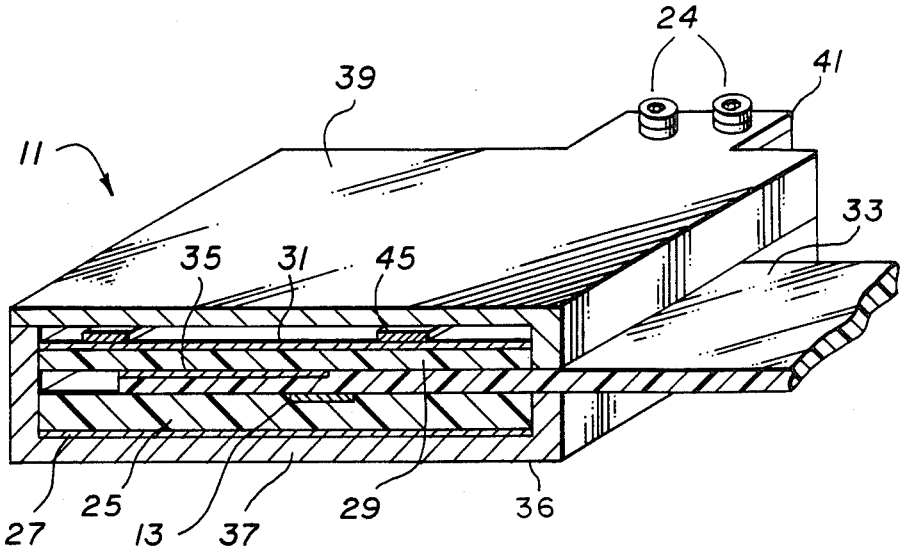
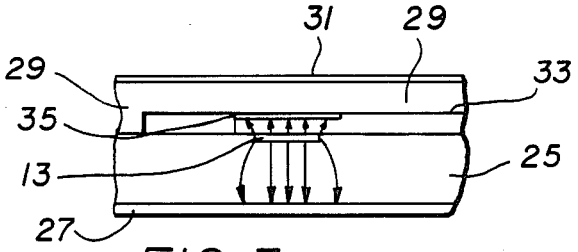
FIG. 3a
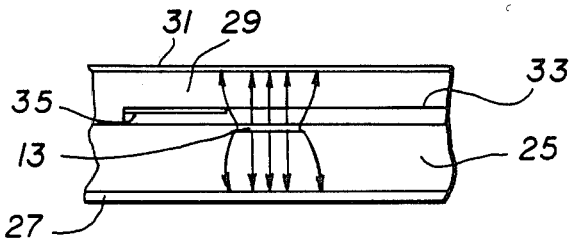
FIG. 3b

MICROWAVE ATTENUATOR

BACKGROUND OF THE INVENTION

1. Field of the Invention

The present invention relates to microwave devices. More specifically, the present invention relates to variable attenuators used in microwave systems.

While the present invention is described herein with reference to a particular embodiment for an illustrative application, it is understood that the invention is not limited thereto. Those having ordinary skill in the art and access to the teachings provided herein will recognize additional modifications, applications and embodiments within the scope thereof.

2. Description of the Related Art

Fixed and variable microwave attenuators provide gain level adjustments for microwave circuits and systems. Commercially available coaxial variable attenuators are large and heavy because their operation requires a relatively long adjustable length of lossy center conductor.

Further, the low performance to weight ratios of conventional variable attenuators limit their practical utility in space applications. Attempts to reduce the size and weight of conventional variable attenuators has resulted in designs having unacceptable performance. As a result, fixed attenuators have been used more often for spacecraft applications.

The use of fixed attenuators, however, is also problematic. For example, it is not known in advance which mix of attenuators is needed for the radiated power and gain requirements of a given system. It is generally necessary, therefore, to have on hand a large number of attenuators. The retention of a sufficient number of attenuators of various ranges often necessitates a large and costly inventory. In addition, a time consuming and costly trial and error method of design is required during which many iterations of different attenuation settings are tried before a final value is determined. It is apparent that a variable attenuator for such applications would be highly desirable.

There is therefore a recognized need in the art for a small, lightweight, inexpensive, high performance variable attenuator suitable for spacecraft systems and other applications demanding high performance to size and weight ratios.

SUMMARY OF THE INVENTION

The above-identified need in the art is addressed by the improved microwave attenuator of the present invention. The invention provides a high performance, low cost variable attenuator with minimal size and weight requirements. The variable microwave attenuator of the present invention includes a microwave stripline transmission line connecting the input and the output thereof; first and second ground planes disposed on opposite sides of the transmission line; and a dielectric card having a metallization pattern disposed on at least a portion thereof. The card is adapted for variable interposition between the transmission line and the first ground plane to provide variable attenuation of microwave energy. A specific teaching of the invention relates to the design of the metallization pattern to provide both a vernier and a match.

BRIEF DESCRIPTION OF THE DRAWINGS

FIG. 2 shows a perspective view, partially in section, of the illustrative embodiment of the variable microwave attenuator of the present invention.

FIG. 3*a* is a schematic illustration of the electric field pattern of the present invention with the dielectric card in for maximum attenuation.

FIG. 3*b* is a schematic illustration of the electric field pattern of the present invention with the dielectric card out for minimum attenuation.

DESCRIPTION OF THE INVENTION

Figure 1:
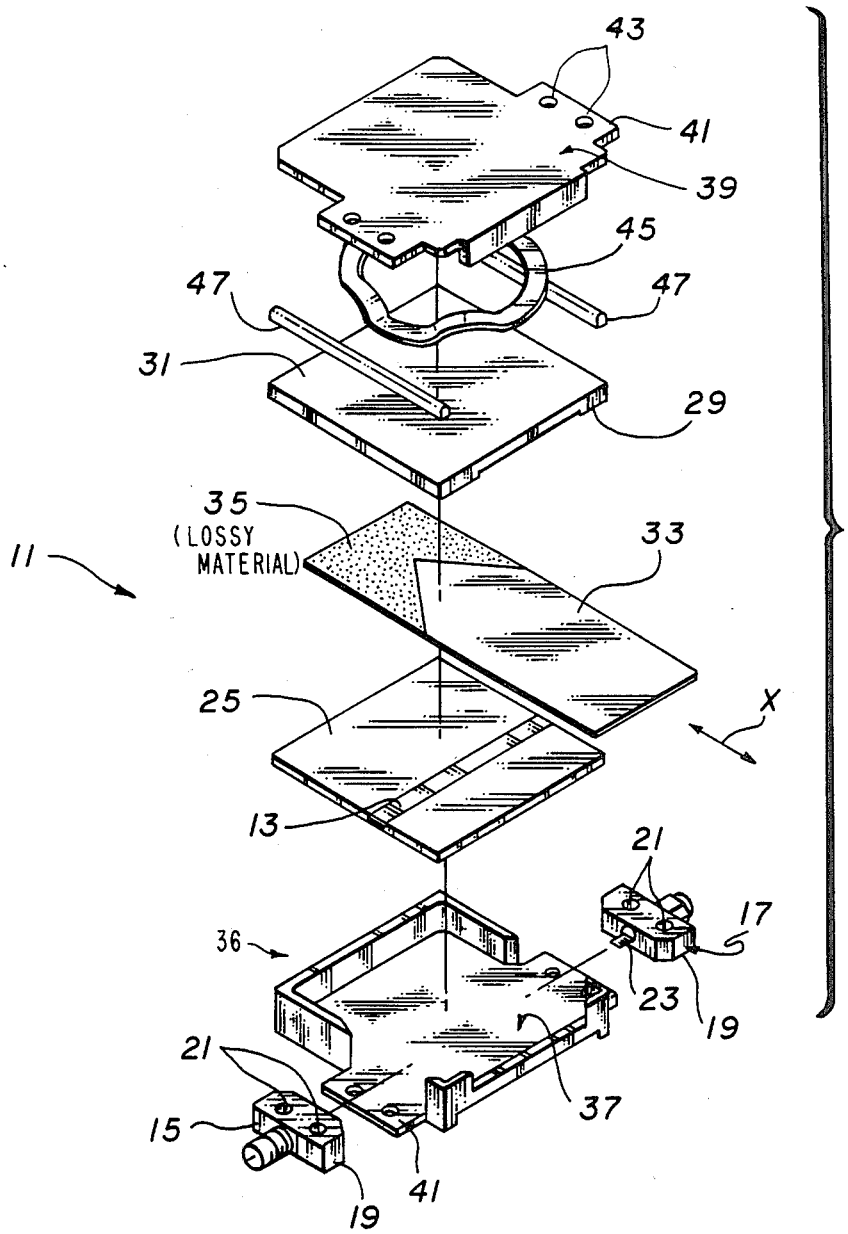
FIG. 1 shows an illustrative embodiment of the variable microwave attenuator of the present invention in disassembled relation.

An illustrative embodiment of a variable attenuator 11 constructed in accordance with the teachings of the present invention is shown disassembled in FIG. 1. A stripline center conductor 13 provides a transmission line between the input and output of the attenuator 11 at coaxial connectors 15 and 17 respectively. As is well known in the art, the connectors 15 and 17 may be SMA or other suitable connectors without departing from the scope of the present invention. The input connector 15 is female and threaded while the output connector 17 is male. Each connector includes a boss 19 with holes for screws 21. The connectors are connected to the stripline 13 by tabs 23. The tabs 23 may be beryllium copper or other suitable material. The tabs 23 are preferably gap welded by a gold ribbon or soldered to the stripline 13.

The stripline center conductor 13 is typically a thin strip, sheet or layer of copper and is mounted or deposited on a first dielectric board 25. The dielectric board 25 has a copper ground plane 27 on the underside thereof. A second dielectric board 29, mounted substantially parallel with the first board 25, has a second copper ground plane 31. It will be appreciated by those skilled in the art that other conductive materials may be used to provide ground planes. The invention is not limited to any particular metallization, dielectric thickness or material. Those skilled in the art may design variable attenuators having metallizations and dielectrics with the proper thickness to achieve satisfactory performance, for a specific application, within the teachings of the present invention.

A particularly advantageous feature of the invention is the provision of a dielectric card 33 with a metallization pattern 35. The card 33 may be of a low loss epoxy glass composition. In the illustrative embodiment, the metallization pattern 35 is a thin film deposition of nichrome; although other suitably lossy materials, known in the art, may be used. The metallization pattern 35 is an inverted taper, approximately one quarter wavelength in width, to provde a match whereas the angle of the V-shaped metallization pattern 35 provides an attenuation vernier. The angle of the metallization pattern and the card thickness may be empirically optimized for a specific application.

The nichrome deposition has a protective coating of Mylar or other suitable material to prevent abrasion during movement. The card 33 is mounted between the first and second dielectric boards 25 and 29 to achieve slidable and therefore variable interposition between the stripline 13 and the second ground plane 31. When properly positioned between the transmission line 13 and the ground planes 27 and 31, the metallization pattern 35 intercepts and attenuates the electric field therebetween. The present invention thus provides variable attenuation in that the degree of attenuation is directly related to the position of the card 33.

The two boards 25 and 29 and the card 33 are sandwiched in close proximity within a housing 36 having a bottom section 37 and a top plate 39. The housing 36 provides structural support and may be fabricated of aluminum, or other suitable material. The bottom section 37 and plate 39 are designed to accommodate the boards 25 and 29 and card 33 and to interfit with one another. Each includes a flange 41 with holes 43 by which the top plate 39 is secured to the bottom section 37 with the bosses 19 therebetween by screws (not shown).

In final assembly, a wavy washer or spring 45 may be included. The wavy washer 45 provides constant pressure within the assembled stack, prevents air gaps and thereby compensates for space or pressure variations which might otherwise be induced by temperature variations.

As shown in FIG. 1, two rubberized gaskets 47 filled with a conductive material, e.g. silver, are positioned within the housing 36 to provide a good rf path between the bosses 19 and the ground plane 31.

FIG. 2 illustrates, in a perspective view, the variable attenuator 11 of the present invention fully assembled and partially in section.

In operation, microwave energy is supplied to the transmission line 13 along which it propagates. FIG. 3*a* provides an illustrative schematic representation of the electric field pattern of the attenuator 11 of the present invention with the metallization pattern 35 in the "in" position to provide full attenuation. Conversely, FIG. 3*b* shows the electric field pattern with the metallization pattern 35 in the "out" position to provide minimum attenuation.

Thus, the present invention provides an improved variable microwave attenuator. While the present invention has been described herein with reference to a particular embodiment for a particular application, the invention is not limited thereto. Those having ordinary skill in the art and access to the teachings provided herein will recognize additional modifications, applications and embodiments within the scope thereof. For example, the invention is not limited to microwave applications. The invention may be used in other applications where variable attenuation of electromagnetic energy is desired. Nor is the invention limited to the shape of the metallization pattern or to the composition of the dielectric and conductive materials used in its construction.

It is therefore intended by the appended claims to cover any and all such modifications, applications and embodiments within the scope of the invention.

Accordingly,

What is claimed is:

1. An improved variable microwave attenuator comprising:

input means, output means and a microwave stripline transmission line connected therebetween;

first and second ground planes disposed on opposite sides of said transmission line; and a dielectric card having a longitudinal axis and a metallization pattern, inverted and V-shaped with respect to said longitudinal axis, disposed on at least a portion of said card, said card being sandwiched between said transmission line and said first ground plane and being adapted for variable interposition therebetween, along said longitudinal axis.

2. The improved variable microwave attenuator of claim 1 wherein said first and second ground planes each include a dielectric board having a planar microwave conductor on one side thereof.

3. The improved variable microwave attenuator of claim 2 wherein the dielectric board of each ground plane includes a dielectric between the planar conductor and the transmission line.

4. The improved variable microwave attenuator of claim 3 wherein said transmission line is disposed on the dielectric side of the dielectric board of the second ground plane.

5. The improved variable microwave attenuator of claim 4 wherein the metallization pattern of said dielectric card is a thin film layer of nichrome.

6. The improved variable microwave attenuator of claim 5 wherein said dielectric card has a low loss substrate of epoxy glass composition.

7. The improved variable microwave attenuator of claim 6 wherein said planar microwave conductors are copper.

8. The improved variable microwave attenuator of claim 7 including a housing and said input means and output means are microwave connectors.

9. The improved variable microwave attenuator of claim 1 wherein said metallization pattern has a protective coating.

* * * * *